US012766361B2

(12) United States Patent
Wallace

(10) Patent No.: US 12,766,361 B2
(45) Date of Patent: Oct. 20, 2026

(54) PORTABLE CONTROLLED KNEE BEND EXERCISE APPARATUS

(71) Applicant: Tyrone A Wallace, Bronx, NY (US)

(72) Inventor: Tyrone A Wallace, Bronx, NY (US)

( * ) Notice: Subject to any disclaimer, the term of this patent is extended or adjusted under 35 U.S.C. 154(b) by 10 days.

(21) Appl. No.: 18/819,011

(22) Filed: Aug. 29, 2024

(65) Prior Publication Data

US 2026/0061252 A1 Mar. 5, 2026

(51) Int. Cl.
*A63B 23/035* (2006.01)
*A63B 21/00* (2006.01)

(52) U.S. Cl.
CPC ..... *A63B 23/03508* (2013.01); *A63B 21/00047* (2013.01)

(58) Field of Classification Search
CPC ..... A63B 21/00047; A63B 23/03508; A63B 23/0494; A61H 1/024; A61F 5/0123
See application file for complete search history.

(56) References Cited

U.S. PATENT DOCUMENTS 4,805,605 A * 2/1989 Glassman ..... A61F 5/0193 128/882
4,844,454 A * 7/1989 Rogers ..... A61H 1/024 482/131
11,833,098 B1 * 12/2023 Keiser ..... A63B 21/00178
12,403,059 B1 * 9/2025 Thornton ..... A61H 1/024
2005/0020417 A1 * 1/2005 Gary ..... A63B 21/028 482/140
2006/0128539 A1 * 6/2006 Marquez ..... A63B 21/055 482/121
2010/0190622 A1 * 7/2010 Johnson ..... A63B 23/0405 482/136
2013/0324382 A1 * 12/2013 Wilson ..... A61H 7/007 482/142
2016/0107058 A1 * 4/2016 Pourshakour ..... A63B 21/4039 482/140
2018/0271436 A1 * 9/2018 Malone ..... A63B 23/0494
2025/0352420 A1 * 11/2025 Williams ..... A61H 1/024

* cited by examiner

*Primary Examiner* — Joshua T Kennedy
(74) *Attorney, Agent, or Firm* — The Keys Law Firm PLLC

(57) ABSTRACT

A portable knee bend exercise apparatus which allows for controlled use of the knee joint for exercise movements so as to reduce or prevent the buildup of scar tissue and to strengthen muscles around the joint. The portable knee bend exercise apparatus includes a wedge body having a support portion suitable to receive the thigh of a user, a lip portion suitable to provide an axis of rotation about which a knee can perform extension and flexion, a tapering portion which allows for full knee flexion, a bottom portion, and a back portion suitable to couple with a seat on which a user in seated. Coupled with the wedge body is a strap member which is structured to both encircle the wedge body and extend above the top surface to selectively form a loop which can secure the leg of a user to the top surface.

14 Claims, 3 Drawing Sheets

PORTABLE CONTROLLED KNEE BEND EXERCISE APPARATUS

BACKGROUND OF THE INVENTION

Field of the Invention

This invention relates generally to a therapeutic exercising apparatus and, more particularly, to a portable apparatus for performing full range of motion knee bend based leg movements while the thigh is restrained.

Description of the Prior Art

For patients recovering from knee replacement surgery, it is well established that it can be very beneficial for the patient to perform rehabilitation exercises involving the knee joint in order to aid recovery. For example, performing exercises involving the knee joint is known to not only reduce or reverse muscle atrophy but also keep scar tissue from building up around the joint as it heals. Research additionally suggests that such exercises can reduce pain and improve the rate of healing.

In addition, for patients who are candidates for knee replacement surgery, it can be beneficial for such patients to work to strengthen the muscles around their affected knee prior to surgery. Indeed, it is understood that when a patient's quadricep muscles that are just above the knee are stronger, they may be better suited to be optimally positioned and connected during such a surgery.

While various forms of exercising devices for muscles around the knee joint exist, there remains a need for a portable exercise apparatus for performing exercises involving bending the knee by a seated user with the user's thigh held in a horizontal position. It would additionally be desirable for such a portable controlled knee bend exercise apparatus to allow for full knee extension as well as for knee flexion beyond 90 degrees. It would furthermore be desirable for such a portable controlled knee bend exercise apparatus to be structured to receive a user's thigh on a viscoelastic surface that is suitable to deform in response to the thigh being placed thereon and is contoured to help facilitate rotational movement of the lower leg.

SUMMARY OF THE INVENTION

The present disclosure provides for a portable controlled knee bend exercise apparatus, comprising: a body having a top side, bottom side, and a front side; wherein the top side includes a first portion which is configured to provide a surface on which a thigh on a target leg of a user can be placed; wherein the front side includes a second portion which is configured to cause the body to taper from the top side to the bottom side; wherein when a user's thigh on the target leg is received in the first portion with the knee on the target leg flexed at 90 degrees, the lower leg of the target leg is positioned in front of the second portion; wherein the body includes a third portion defined by a tube shaped member which extends laterally across the body and is adjacent to the front side and to the top side; and wherein when a user's thigh on the target leg is received in the first portion with the knee on the target leg flexed at 90 degrees, the third portion provides an axis of rotation about which the knee on the target leg can perform extension and flexion.

Embodiments of the portable controlled knee bend exercise apparatus may additionally comprise a strap member integral with the body, wherein at least a strap portion of the strap member selectively loops above the top side.

It is an object of the present disclosure to provide a portable exercise apparatus for performing exercises involving bending the knee by a seated user with the user's thigh held in a horizontal position.

It is an additional object of the present disclosure to provide a portable exercise apparatus which allows for full knee extension as well as for knee flexion beyond 90 degrees.

It is an additional object of the present disclosure to provide a portable exercise apparatus which can receive a user's thigh on a viscoelastic surface that is suitable to deform in response to the thigh being placed thereon and is contoured to help facilitate rotational movement of the lower leg.

DETAILED DESCRIPTION OF THE INVENTION

Described herein is a portable knee bend exercise apparatus for rehabilitation of knee and quadriceps muscles, including for patients recovering from knee replacement surgery, which allows for controlled use of the knee joint for exercise movements so as to reduce or prevent the buildup of scar tissue and to strengthen muscles around the joint. The portable knee bend exercise apparatus includes a wedge body having a support portion suitable to receive the thigh of a user, a lip portion suitable to provide an axis of rotation about which a knee can perform extension and flexion, a tapering portion, a bottom portion, and a back portion suitable to couple with a seat on which a user in seated. Coupled with the wedge body is a strap member which is structured to both encircle the wedge body and extend above the top surface to selectively form a loop which can secure the leg of a user to the top surface. These components allow the portable knee bend exercise apparatus to be able to receive and hold the leg of a user, couple to a seat on which a user may be on, and allow for controlled extension and flexion movements involving the knee.

Figure 1:
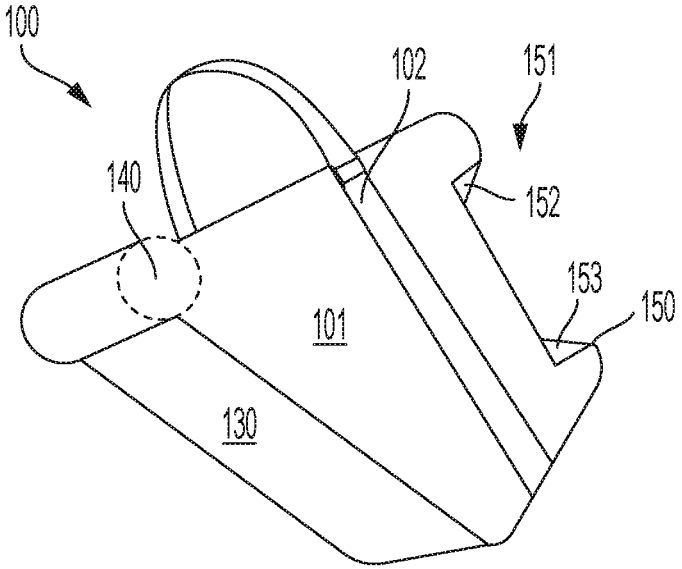
FIG. 1 is a bottom right perspective view of a portable controlled knee bend exercise apparatus built in accordance with the present invention.
Figure 2:
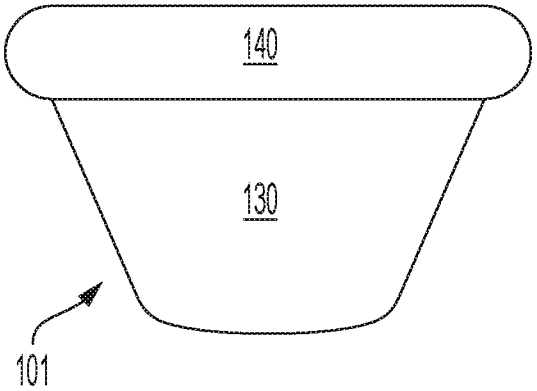
FIG. 2 is a front elevational view of a portable controlled knee bend exercise apparatus built in accordance with the present invention, shown with its strap member removed.
Figure 3:
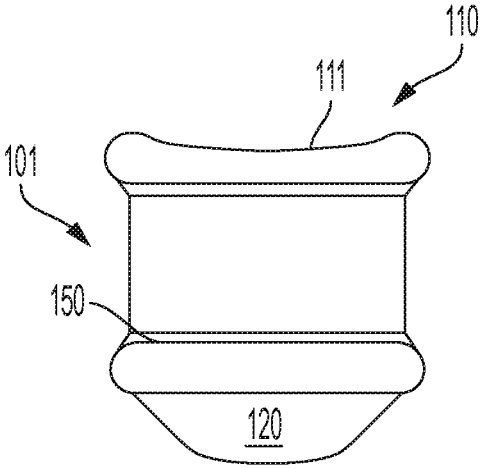
FIG. 3 is a rear elevational view of a portable controlled knee bend exercise apparatus built in accordance with the present invention, shown with its strap member removed.
Figure 4:
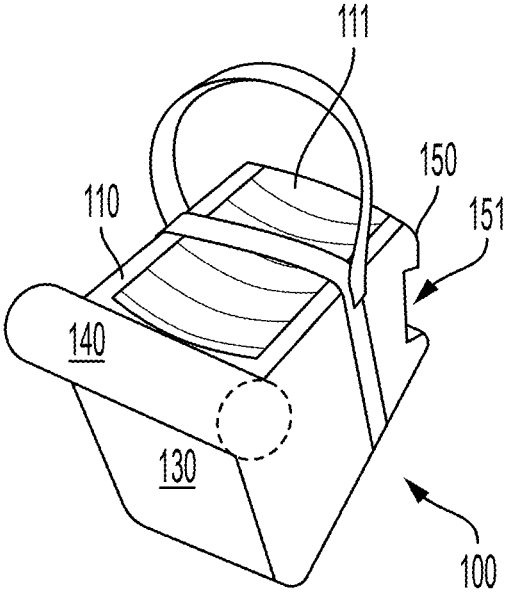
FIG. 4 is a top right perspective view of a portable controlled knee bend exercise apparatus built in accordance with the present invention.
Figure 5:
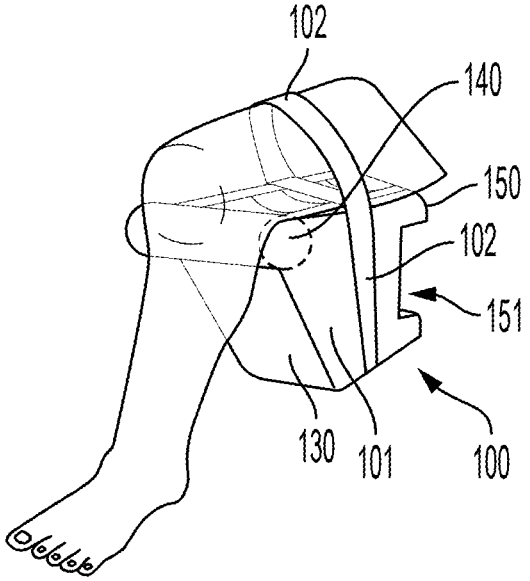
FIG. 5 is a right perspective view of a portable controlled knee bend exercise apparatus built in accordance with the present invention, shown with the lower leg in a 90 degree angle.
Figure 6:
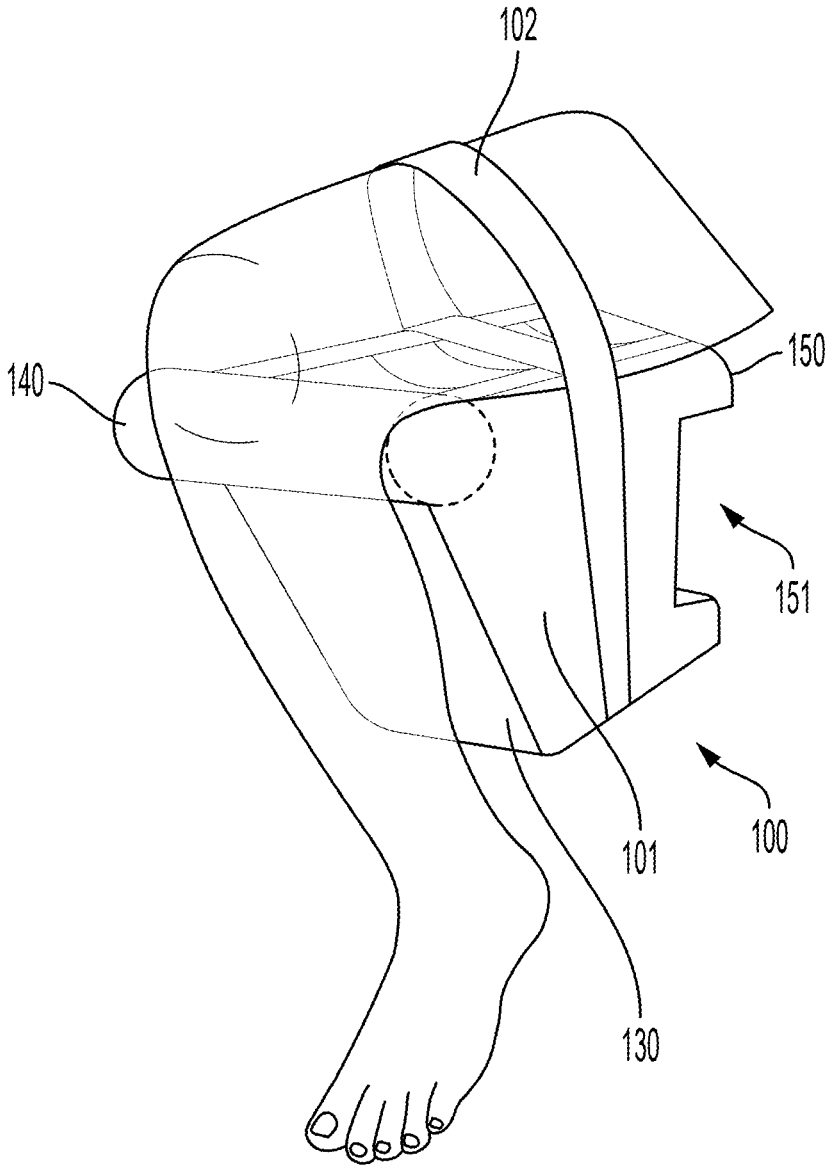
FIG. 6 is a right perspective view of a portable controlled knee bend exercise apparatus built in accordance with the present invention, shown with the lower leg in a knee flexion angle of between 120 degrees and 135 degrees.

Referring now to the drawings and, in particular, FIGS. 1, 2, 3, 4, 5 and 6, a portable controlled knee bend exercise apparatus 100 is shown having a wedge body 101 and a strap member 102. The wedge body 101 may be defined by a block of memory foam (i.e., viscoelastic polyurethane foam) having a density of 2 to 6 pounds per cubic foot formed as a pillow which has a top side, bottom side, front side, rear side, a left side and a right side. The block which forms the wedge body 101 may be manufactured as a single mold, thereby forming a unitary member. The wedge body 101 includes a support portion 110, a bottom portion 120, a tapering portion 130, a lip portion 140, and a back portion 150. The strap member 102 may be constructed of nylon webbing, include hook and loop fasteners in order to be selectively secured around a leg, and may measure 2 inches wide and 57 inches long in some embodiments.

The support portion 110 may be defined by an elongated surface on the top side of the wedge body 101, running from a location adjacent to the rear side of the wedge body 101 to a location adjacent to the front side of the wedge body 101. With its general planar profile, the support portion 110 is configured to provide a surface on which the thigh of a user of the portable controlled knee bend exercise apparatus 100 can be placed. The support portion 110 may additionally include a curved depression 111 which is shaped to contour to the shape of the back of the thigh of a user. In this regard, it is through the curved depression 111 of the support portion 110 that the wedge body 101 is configured to contour the thigh of a user. The support portion 110 may measure 17 inches in length in some embodiments while the curved depression may measure 7 inches across.

The bottom portion 120 may be defined by a planar, elongated surface on the bottom side of the wedge body 101. Like the support portion 110, the bottom portion 120 runs from a location adjacent to the rear side of the wedge body 101 to a location adjacent to the front side of the wedge body 101. The bottom portion 120 is sloped such that the distance between the bottom portion 120 and the support portion 110 decreases as the bottom portion 120 extends away from the front side to the rear side of the wedge body 101.

The tapering portion 130 may be defined by a planar, elongated surface on the front side of the wedge body 101, running from a location adjacent to the top side of the wedge body 101 to a location adjacent to the bottom side of the wedge body 101. The tapering portion 130 is sloped such that the distance between tapering portion 130 and the rear side of the wedge body 101 decreases as the tapering portion 130 extends away from the top side towards the bottom side. Through this slope, wedge body 101 is configured to taper from the top side to the bottom side.

The lip portion 140 may be defined by a tube shaped member disposed on the front side of the wedge body 101, extending laterally across the wedge body 101. The tube shape of the lip portion 140 allows it to provide an axis of rotation about which a knee can perform extension and flexion. The lip portion 140 forms the topmost aspect of the front side and the frontmost aspect of the top side of the wedge body 101. In this regard, the lip portion 130 extends outwardly from the frontmost part of the support portion 110 and topmost part of the tapering portion 130. The lip portion 140 may be formed to have a 3 inch diameter. The lip portion 140 combined with the tapering portion 130 may be formed to extend a total of 9½ inches.

The back portion 150 is disposed on the rear side of the wedge body 101, running from a location adjacent to the top side of the wedge body 101 to a location adjacent to the bottom side of the wedge body 101. The back portion 150 includes a lateral recess 151 having an upper surface 152 and a lower surface 153 and which may be suitable to receive the front (or whichever side a user's leg is extending in front of) of an apron and/or seat of a chair, bench, or other piece of furniture on which a user of the portable controlled knee bend exercise apparatus 100 is seated. In this regard, it is through the lateral recess 151 of the back portion 150 that the wedge body 101 is configured to selectively couple with a seat on which a user is seated.

In use, the portable controlled knee bend exercise apparatus 100 may operate to allow a user to direct attention to building up the quadricep muscles by performing a couple of simple straight forward exercises. The portable controlled knee bend exercise apparatus 100 may be placed level on any side of a bed, or placed level in front of a chair or a sofa while the user places the thigh of target leg in the curved depression 111 of the support portion 110 so that the knee of the target leg is over the lip portion 140. Once the leg is in place in this manner, the strap member 102 may be looped around the leg and fastened in a loop using the opposing side of a hook and loop fastener in a similar manner as a cinch strap. Once the strap is in place, the user can now perform an extension movement by lifting their lower leg (i.e., the area around the tibia and fibula) upward (to their tolerance), extending the leg forward and bringing up the foot to be level with the knee. If the leg is able to be extended so as to be completely horizontal, that would represent a full extension (0 degrees). Then, the user can perform a flexion movement by bending the knee, ideally continuing as far as they can go. While a target of full flexion (140 degrees) would be desired, the objective would be for the user to do their best and ideally progress over time. To progress, the user would continue doing this up-and-down motion to activate stimulation in the quadricep muscles that are directly above the knee.

It is contemplated that the sloped angle of the tapered portion 140 would enable up to a full flexion of the knee.

Exercises after knee replacement surgery are very important and much more intense because of the patient's pain. As such, it is contemplated that back and forth motions by a user may need to be done slowly, and only as far back as the patient can go.

A user may perform a protocol which entails lifting up as far as their leg can lift, then holding for at least 6 seconds, then slowly going downward under control to 90 degrees where they then would rest 12 seconds. Then, they could continue toward full flexion as far back as the user can bend, then hold for 6 seconds, then release slowly back to 90 degrees. This can be repeated for 5 to 10 repetitions 3 times daily once the user is given doctor's approval for rehabilitation exercises. For 3 sets a day, it may be beneficial to do a first set in the morning, a second set in the afternoon, and a third set in the evening. It is contemplated that such a protocol will prevent the buildup of scar tissue in the knee joints while the patient is healing from knee surgery. While the formation of scar tissue is part of the healing process, it is not desirable between the joints because within movable joints, scar tissue can prevent regaining a full range of motion for the joint.

Embodiments of a portable controlled knee bend exercise apparatus built in accordance with the present invention may alternatively be made from alternate medical friendly materials, such as molded acrylic, molded firm plastic, or a molded piece of wood, such as bamboo.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable knee bend exercise apparatus, comprising:
a body having a top side, bottom side, and a front side;
wherein the top side includes a first portion which is configured to provide a surface on which a thigh on a target leg of a user can be placed;
wherein the front side includes a second portion which is configured to cause the body to taper from the top side to the bottom side;
wherein when a user's thigh on the target leg is received in the first portion with the knee on the target leg flexed at 90 degrees, the lower leg of the target leg is positioned in front of the second portion;
wherein the body includes a third portion defined by a partially cylindrical body which extends laterally across the body, is adjacent to the front side and to the top side, and extends outwardly beyond at least one of the front side and the top side; and
wherein when a user's thigh on the target leg is received in the first portion with the knee on the target leg flexed at 90 degrees, the third portion provides an axis of rotation about which the knee on the target leg can perform extension and flexion and the second portion causes the body to taper sufficiently to allow the knee on the target leg to be flexed beyond 90 degrees, at least to an angle between 120 degrees and 135 degrees; and the body additionally having a rear side which includes a fourth portion that includes a lateral recess which extends across the body and includes an upper surface as well as a lower surface that is opposite and generally parallel to the upper surface such that the lateral recess is configured to receive a surface on which a user of the portable controlled knee bend exercise apparatus is seated.

2. The portable knee bend exercise apparatus of claim 1, additionally comprising a strap member integral with the body, wherein at least a strap portion of the strap member selectively loops above only the top side.

3. The portable knee bend exercise apparatus of claim 1, wherein the first portion includes a longitudinal depression.

4. The portable knee bend exercise apparatus of claim 1, wherein when a user's thigh on the target leg is received in the first portion with the knee on the target leg flexed at 90 degrees and a calf of the target leg adjacent to the front side, the second portion causes the body to taper sufficiently to allow the knee on the target leg to be flexed an angle up to 140 degrees.

5. A portable knee bend exercise apparatus, comprising:
a body having an elongated top side, elongated bottom side, elongated front side, and elongated rear side, with the top side extending from a first location adjacent to the front side to the rear side, the rear side extending from the top side to the bottom side, the bottom side extending from the rear side to the front side, and the front side extending from the bottom side to a second location adjacent to the top side;
wherein the body includes an extended portion defined by a member which extends laterally across the body and outwardly from both the front side and to the top side;
wherein the front side is defined by a tapering portion which is sloped such that the linear distance between the front side and the rear side decreases as the front side extends away from the top side towards the bottom side; and
wherein when a thigh on a target leg of a user is received in the top side with a lower leg of the target leg positioned in front of the front side, the tapering portion is positioned relative to the extended portion and shaped to allow the knee on the target leg to be flexed beyond 90 degrees, at least to an angle between 120 degrees and 135 degrees; and the body additionally having a rear side which includes a fourth portion that includes a lateral recess which extends across the body and includes an upper surface as well as a lower surface that is opposite and generally parallel to the upper surface such that the lateral recess is configured to receive a surface on which a user of the portable controlled knee bend exercise apparatus is seated.

6. The portable knee bend exercise apparatus of claim 5, wherein the extended portion is partially cylindrical shaped.

7. The portable knee bend exercise apparatus of claim 6, wherein the top side includes a support portion which is configured to provide a surface on which the thigh on the target leg of a user can be placed.

8. The portable knee bend exercise apparatus of claim 7, wherein the support portion has a surface which includes an elongated depression.

9. The portable knee bend exercise apparatus of claim 8, additionally comprising a strap member integral with the body, wherein at least a strap portion of the strap member selectively loops only above the top side.

10. The portable knee bend exercise apparatus of claim 5, wherein the top side includes a support portion which is configured to provide a surface on which the thigh on the target leg of a user can be placed.

11. The portable knee bend exercise apparatus of claim 10, wherein the support portion has a surface which includes an elongated depression.

12. The portable knee bend exercise apparatus of claim 11, additionally comprising a strap member integral with the body, wherein at least a strap portion of the strap member selectively loops only above the top side.

13. The portable knee bend exercise apparatus of claim 5, wherein when the thigh on a target leg of a user is received in the top side with a calf of the target leg adjacent to the front side, the tapering portion is shaped to allow the knee on the target leg to be flexed to an angle up to 140 degrees.

14. A portable knee bend exercise apparatus, comprising:
a body having a top side, bottom side, and a front side;
a strap member integral with the body, wherein at least a strap portion of the strap member selectively loops above the top side;
wherein the top side includes a first portion which is configured to contour to a thigh on a target leg of a user;
wherein the front side includes a second portion which is configured to cause the body to taper from the top side to the bottom side;
wherein when a user's thigh on the target leg is received in the first portion with the knee on the target leg flexed at 90 degrees, the lower leg of the target leg is positioned in front of the second portion;
wherein the body includes a lip portion adjacent to the front side and to the top side and which extends outwardly beyond both the front side and the top side; and
wherein when a user's thigh on the target leg is received in the first portion with the knee on the target leg flexed at 90 degrees, the lip portion is positioned to provide an axis of rotation about which the knee on the target leg can perform extension and flexion and the second portion causes the body to taper sufficiently to allow the knee on the target leg to be flexed beyond 90 degrees, at least to an angle between 120 degrees and 135 degrees; and the body additionally having a rear side which includes a fourth portion that includes a lateral recess which extends across the body and includes an upper surface as well as a lower surface that is opposite and generally parallel to the upper surface such that the lateral recess is configured to receive a surface on which a user of the portable controlled knee bend exercise apparatus is seated.

* * * * *